US005085230A

United States Patent [19]

Roman

[11] Patent Number: 5,085,230

[45] Date of Patent: Feb. 4, 1992

[54] SMOKER'S APPLIANCE

[76] Inventor: Bernard J. Roman, 7241 Wembley Ter., Toledo, Ohio 43617

[21] Appl. No.: 581,807

[22] Filed: Sep. 13, 1990

[51] Int. Cl.[5] ..... A24F 19/14

[52] U.S. Cl. ..... 131/235.1; 131/240.1; 131/242; 131/241; 131/256

[58] Field of Search ..... 131/235.1, 240.1, 242, 131/241, 256

[56] References Cited

U.S. PATENT DOCUMENTS

| | | | |
|---|---|---|---|
| 1,874,319 | 2/1930 | Lill | 131/235.1 |
| 2,340,618 | 8/1942 | Schiszler | 131/235.1 |
| 2,348,423 | 5/1944 | Schylander | 131/235.1 |
| 2,625,163 | 1/1953 | Jones et al. | 131/175 |
| 2,883,992 | 6/1955 | Hastings | 131/235.1 |
| 2,894,514 | 7/1959 | Moore | 131/242 |
| 3,165,105 | 5/1963 | Campbell | 131/235.1 |
| 3,386,452 | 6/1968 | Davis | 131/235.1 |
| 3,468,317 | 2/1967 | Rowland | 131/235.1 |
| 4,236,539 | 12/1980 | Mosby, Jr. | 131/242 |
| 4,354,510 | 10/1982 | Eakin | 131/235.1 |
| 4,423,743 | 1/1984 | Spielvogel | 131/240.1 |
| 4,497,329 | 2/1985 | O'Dell | 131/235.1 |
| 4,572,217 | 2/1986 | Newman, Sr. et al. | 131/175 |
| 4,920,988 | 5/1990 | Cancellara | 131/240.1 |

*Primary Examiner*—V. Millin

*Assistant Examiner*—Lynne A. Reichard

*Attorney, Agent, or Firm*—Marshall & Melhorn

[57] ABSTRACT

A smoker's appliance for the reduction of a quantity of smoke emanating from a lighted cigarette during periods of time the lighted cigarette is not being smoked includes a hollow support body having a bottom edge for engaging a supporting surface and a wall with a plurality of retaining apertures formed therein, a plurality of receptacle for retaining cigarettes, each receptacle having a generally tubular body with a cylindrical outer surface and a longitudinally extending aperture of polygonal cross section extending between an outer end and an inner end of the tubular body and a fastener for maintaining each of the receptacles in an associated one of the retaining apertures whereby heat energy from the lighted end of a cigarette inserted in one of the receptacles is dissipated through the tubular body and the amount of oxygen supplied to the cigarette is decreased. The support body can be frustum shaped with an open top and bottom and formed of a plastic material while the receptacles are formed of a metal material. The receptacle tubular body has a radially outwardly extending flange formed at the outer end and a chamfer formed on the flange at an entrance to the longitudinally extending aperture for receiving a lighted end of a cigarette.

23 Claims, 1 Drawing Sheet

SMOKER'S APPLIANCE

BACKGROUND OF THE INVENTION

The present invention relates generally to an appliance for use by a smoker and, in particular, to an apparatus for reducing the quantity of smoke emanating from a lighted cigarette during periods of time the cigarette is positioned within the apparatus.

A number of apparatuses have been utilized to diminish the secondhand smoke generated by a smoldering cigarette in the surroundings of the actual smoker and the passive smoker. U.S. Pat. No. 2,340,618 discloses a receptacle for lighted cigarettes which diminishes the emanation of smoke by admitting only enough oxygen to the receptacle to permit slow burning for a short time. The cigarette is inserted vertically into a hole and the lighted end of the cigarette rests on a ledge formed around the interior of the receptacle. Due to a lack of oxygen, the cigarette is snuffed out after approximately one minute.

U.S. Pat. No. 2,348,423 discloses an ash tray supporting a spaced apart hood on a column. The hood has a plurality of snuffers formed as thimbles extending inwardly and downwardly from the sides of the hood. Each of the thimbles is open at both ends for receiving a cigarette. The lighted end of the cigarette extends inwardly beyond the open inner end of the thimble. The cigarette will burn for a minute or so and then go out which substantially eliminates the smoke from the cigarette once it is positioned within the thimble.

U.S. Pat. No. 4,497,329 discloses a cigarette snuffer for extinguishing a burning cigarette. The burning cigarette is inserted vertically into a cylindrical tube having an internal ridge for compressing the unburned material of the cigarette. The compression is sufficient to restrict the flow of air in the unburned material. The portion of the cigarette which is burning quickly uses up available oxygen and is smothered within a few seconds.

U.S. Pat. No. 1,874,319 discloses an ash tray having a hollow body and a lid covering an upper open end. The lid has tapered openings and another opening extending therethrough to the interior of the body. A peripheral flange formed on the lid has radially arranged troughs, and is adapted to rest on the upper end of the body. A lighted cigarette can be inserted into one of the tapered openings to snuff it out or through the another opening into the interior of the body. A lighted cigarette also can be placed in one of the troughs whereby ashes will fall through the openings into the body.

U.S. Pat. No. 2,883,992 discloses an apparatus for a smoker having an extinguisher and a support for lighted cigarettes adapted for use in an ashtray. The apparatus has an open top receptacle and column supporting a shallow cylindrically shaped framework formed of spaced apart generally horizontally extending upper and lower plates connected by a side wall. The top plate is provided with apertures of sufficient size to receive a cigarette, and some of the apertures are positioned above tubes mounted in the interior of the framework to snugly and tightly engage a cigarette. Apertures are provided in the lower plate aligned with the apertures in the upper plate but of insufficient size to enable a cigarette to pass therethrough. Apertures are provided in the side wall and a rotatable ring in the interior of the framework for controlling the air admitted to the interior. A cigarette can be inserted into the upper plate and will be extinguished if inserted into one of the tubes or if the side wall apertures are misaligned to cut off the air flow. A timed extinguishment of the cigarette can be controlled by the alignment of the side wall apertures relative to one another to adjust the air flow to the interior of the framework.

U.S. Pat. No. 3,165,105 discloses a cigarette having an ash retaining trough-shaped member, formed of a fire resistant material, positioned beneath the forward portion of the cigarette to support the cigarette ashes' cool the smoke and condense undesirable chemical substances before they reach the mouth of the smoker. A snuffer band encircles the cigarette at the rear of the trough to automatically extinguish the cigarette.

U.S. Pat. No. 3,386,452 discloses a cigarette extinguisher having an extended tubular portion large enough to receive a lighted end of a cigarette. The tubular portion is tapered towards an inwardly extending flange formed at the lower end and has a flared upper end with dimples for securing the tubular portion to a supporting plate. A cigarette is inserted vertically into the tubular portion and the flange prevents the cigarette from passing through the open lower end. The cigarette is forced or pressed against the walls of the tubular portion and heat is conducted away from the lighted end to extinguish the cigarette.

U.S. Pat. No. 3,468,317 discloses a collapsible and stackable ash receptacle made from a laminate of paper and foil or other non flammable material. An inwardly projecting non-inflammable, short cigarette supporting ledge is positioned between a bottom end of the receptacle and a upper end of the receptacle and projects away from a rear wall and upwardly therefrom at an angle between 32° and 64°. The ledge is perforated by a plurality of openings to enable a lighted cigarette end supported thereby to continue burning. The ledge is sufficiently stiff to enable a lighted cigarette end to be extinguished by forcing the cigarette against the ledge.

U.S. Pat. No. 4,354,510 discloses a cigarette snuffing device which includes a small hollow cylinder which is attached by a bracket to a guide funnel to facilitate the vertical insertion of a lip portion of a cigarette into the cylinder. An annular ridge is located at approximately the midpoint between the ends of the inside of the cylinder. The cigarette is vertically inserted through the funnel into the cylinder until contact is made with the annular ridge. The contact of the cigarette with the ridge forms a seal which prevents oxygen from flowing through the cylinder. The burning cigarette quickly dissipates any available oxygen contained with the cylinder and is extinguished.

SUMMARY OF THE INVENTION

The present invention concerns an smoker's appliance for reducing smoke from a cigarette which is not being smoked. The appliance achieves this function through the dissipation of heat energy by and the diminishment of the oxygen supply to a cigarette holding receptacle having a polygonal cross section.

The smoker's appliance includes a hollow support body having a bottom edge for engaging a supporting surface and a wall with a plurality of retaining apertures formed therein, a plurality of receptacles for retaining cigarettes, each receptacle having a generally tubular body with a cylindrical outer surface and a longitudinally extending aperture of polygonal cross section extending between an outer end and an inner end of the tubular body and a fastener for maintaining each of the receptacles in an associated one of the retaining apertures whereby heat energy from the lighted end of a cigarette inserted in one of the receptacles is dissipated through the tubular body and the amount of oxygen supplied to the cigarette is decreased. The support body can be frustum shaped with an open top and bottom and formed of a plastic material while the receptacles are formed of a metal material. The receptacle tubular body has a radially outwardly extending flange formed at the outer end and a chamfer formed on the flange at an entrance to the longitudinally extending aperture for receiving a lighted end of a cigarette.

The fastening means can include threads formed on the cylindrical outer surface of each of the tubular bodies for threadably engaging walls of the retaining apertures. The smoker's appliance also can include a removable lid covering the open upper end of the support body. Furthermore, the support body can have an outwardly and upwardly extending flange formed at the bottom edge for capturing cigarette ashes falling from the receptacles.

An object of the present invention is to maintain a lighted cigarette in a slow burning state without emitting the unhealthy and distasteful smoke of a smoldering cigarette.

A further object of the invention is to substantially eliminate the smoke emanated by cigarettes from the surroundings of both smokers and non-smokers.

Still another object of the present invention is to prevent an objectionable acrid taste from developing in lighted cigarettes maintained in the smoker's appliance.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
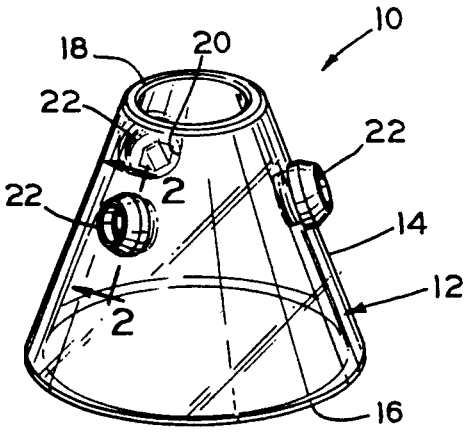
FIG. 1 is a perspective view of a smoker's appliance in accordance with the present invention.

Referring to the FIG. 1, there is illustrated a smoker's appliance generally indicated by the reference numeral 10. The appliance 10 includes a frustum shaped support body 12 having a hollow interior and an open top and bottom. The body 12 is defined by a wall 14 of generally uniform wall thickness T which wall tapers inwardly from bottom to top.

Figure 2:
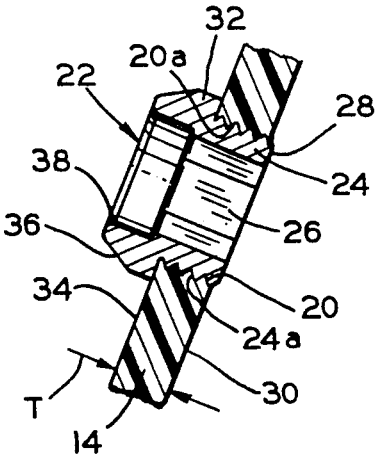
FIG. 2 is an enlarged cross sectional fragmentary view of the smoker's appliance shown in FIG. 1 taken along line 2—2.
Figure 3:
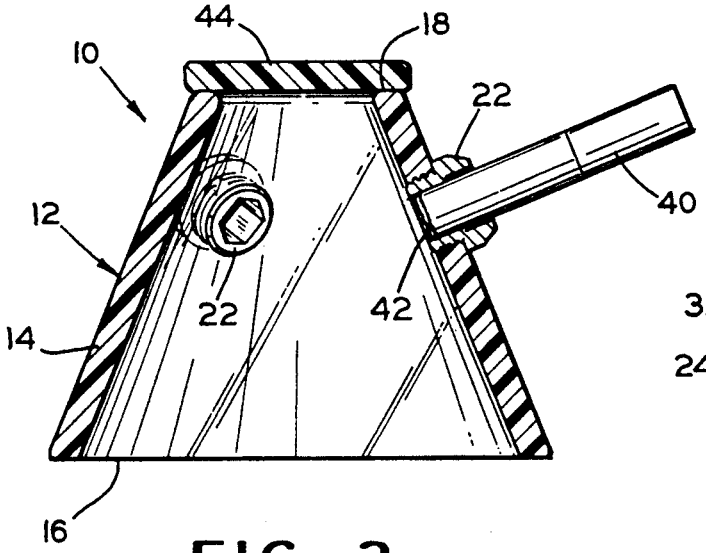
FIG. 3 is a side elevation view of the smoker's appliance shown in FIG. 1 in cross section and including an optional lid.

The support body 12 can be composed of any material which is resistant to the heat generated by a lighted cigarette. The body 12, as illustrated in FIGS. 1 through 3, can be formed of a transparent material such as a suitable plastic, for example. It should be understood that the body 12 need not be made transparent to function properly.

A lower edge 16 of the wall 14 lies in a horizontally extending plane perpendicular to the longitudinal axis of the support body 12. The edge 16 enables the body 12 to stand upright on any horizontal surface and the diameter of the edge 16 at the outer surface of the body is sufficient to prevent accidental overturning of the smoker's appliance 10.

An upper edge 18 of the wall 14 also lies in a horizontally extending plane generally perpendicular to the longitudinal axis of the body 12. The edge 18 is configured to support a lid or closure as will be discussed below.

The wall 14 has a plurality of apertures 20 formed therein. Although three such apertures are shown, one is sufficient and any number can be provided based upon the size of the support body 12. Each of the apertures 20 retains a generally tubular receptacle 22 by any suitable fastener means. For example, the receptacles 22 can be provided with external threads which form threads in the walls of the apertures 20, or the apertures 20 can be provided with matching threads to threadably receive and retain the receptacles 22 as illustrated. It should be understood that there are numerous alternative fastener means by which the receptacles 22 can be retained, such as an adhesive. The receptacles 22 can be formed of any material which is both a good conductor of heat and resistant to fire, such as a metal.

As best shown in FIG. 2, the receptacles 22 have a tubular body 24 with a generally cylindrical outer surface and a cigarette receiving longitudinally extending inner aperture 26 of generally polygonal cross section. An inner end 28 of the receptacle body 24 is positioned adjacent an inner surface 30 of the wall 14. An outer end of the body 24 has a radially outwardly extending flange 32 formed thereon abutting an outer surface 34 of the wall 14. The flange 32 can have a chamfer 36 formed on an outer edge thereof and a chamfer 38 formed at the entrance to the aperture 26. The outer surface of the body 24 has threads 24*a* formed thereon for engaging threads 20*a* formed on the facing wall surface of the aperture 20.

Figure 4:
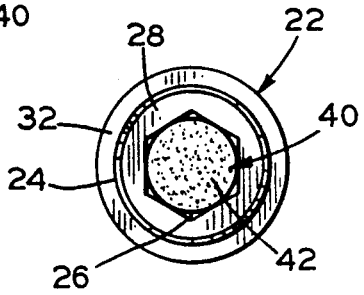
FIG. 4 is an enlarged rear elevation view of one of the cigarette receptacles shown in FIG. 1 with a cigarette inserted.

The smoker's appliance 10 is particularly useful in reducing the quantity of smoke emanating from the lighted end of a cigarette when the cigarette is not being smoked. Such smoke can be offensive to a smoker and a non-smoker. A cigarette 40 can be inserted into the receptacle 22 as shown in FIGS. 3 and 4. A lit end 42 of the cigarette 40 is inserted into the aperture 26. The diameter of the cigarette is approximately equal to the shortest dimension across the aperture 26. In the case of the hexagonal interior illustrated in FIG. 4, the shortest dimension is between pairs of opposed walls such that the cigarette 40 is tightly secured with the lit end 42 inside the inner end 28 of the receptacle. Unlike the prior art devices described above, the cigarette will not be extinguished immediately, but will continue to burn at a very slow rate and without producing smoke for several minutes.

After the cigarette 32 is inserted into the receptacle 22, it becomes dormant for several minutes. When positioned within the receptacle 22, the lit end 42 of the cigarette 40 is surrounded by still air which fills the gaps between the outer surface of the cigarette 40 and the inner walls of the aperture 26. The hollow body 12 of the smoker's appliance 10 permits air to reach the inner ends 28 of the receptacles 22, but minimizes air circulation and drafts which can upset the slow burning of the cigarette 40. Also, due to the relatively high thermal conductivity of the metal receptacles 22, heat is transferred away from the lit end 42 of the cigarette 40 further maintaining the slow burning state of the cigarette. If the lit end 42 is not removed from the receptacle 22 after several minutes, the cigarette 40 is extinguished. The bottom portion of the hollow body 12 cooperates with the surface upon which it rests to define a cigarette ash collecting chamber.

A generally plate shaped cover 44 can be provided for the smoker's appliance 10 as shown in FIG. 3. A lower face of the cover 44 rests on the upper edge 18 and closes the open upper end of the support body 12. The cover 44 further aids in the prevention of air circulation and drafts in the interior of the body 12 and the prevention of smoke escaping from the interior of the body 12.

Figure 5:
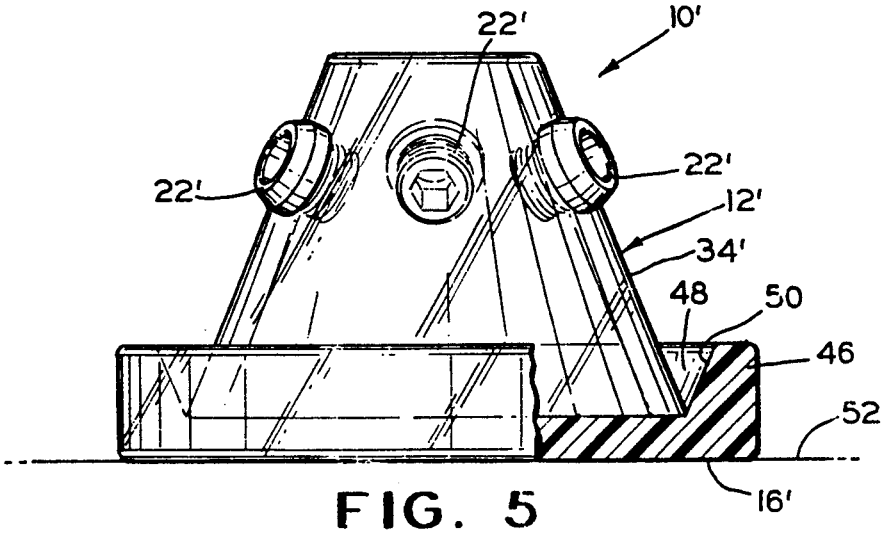
FIG. 5 is a side elevation view in partial cross section of an alternative embodiment of the smoker's appliance in accordance with the present invention.

As the cigarette 40 is being inserted in or removed from the receptacle 22, ashes can fall from the lit end 42. In an alternate embodiment shown in FIG. 5, a smoker's appliance 10' can be provided with a suitable means for capturing the ashes, such as a rim 46, for example. A lower edge 18' of a support body 12' has an outwardly and upwardly extending flange formed thereon defining the rim 46 and an area 48 between an outer surface 34' of the body 12' and an inner surface 50 of the rim 46. Thus, ashes falling from any of a plurality of receptacles 22' are collected in the area 48 instead of landing on a surface 52 on which the smoker's appliance 10' is supported.

The smoker's appliance according to the present invention benefits the smoker by creating the opportunity for a smoker to deposit a cigarette into a convenient place for short time without complete extinguishment and simultaneously prevent the cigarette from emitting objectionable smoke which comes from a smoldering cigarette. If the smoker forgets about the cigarette or decides not to smoke it further, the smoker's appliance will extinguish it within a short time. Ordinarily, when a cigarette has been extinguished and relit, the smoke has an objectionable acrid taste. A cigarette may be extinguished within one of the receptacles of the present invention and thereafter be relit and smoked anew without generating an objectionable acrid taste. The smoker's appliance also benefits the non-smoker by effectively diminishing the cigarette smoke within the air surrounding the non-smoker in the company of a smoker.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In a smoker's appliance for retaining a cigarette having at least one receptacle for a cigarette, the receptacle comprising:

a tubular body having a longitudinally extending aperture of polygonal cross section formed therein, said aperture extending between an outer end and an inner end of said body and having walls for abutting and retaining a lighted end of a cigarette in a dormant state for an extended period of time, wherein said body has a radially outwardly extending flange formed at the outer end thereof.

2. The receptacle according to claim 1 including a chamfer formed on said flange at an entrance to said aperture for receiving a lighted end of a cigarette.

3. The receptacle according to claim 1 wherein said body has a generally cylindrical outer surface.

4. The receptacle according to claim 1 wherein said body is a relatively good conductor of heat.

5. The receptacle according to claim 4 wherein said body is formed from a metal material.

6. The receptacle according to claim 1 wherein said body has fastening means for attaching said receptacle to a support body.

7. The receptacle according to claim 6 wherein said fastening means is threads formed on an exterior surface of said tubular body.

8. A smoker's appliance for retaining a lighted cigarette in a dormant state comprising:

a support body having a bottom edge adapted to rest on a supporting surface and an upstanding wall; and at least one receptacle extending through and attached to said wall, said receptacle having a tubular body with a longitudinally extending aperture of polygonal cross section formed therein between an outer end and an inner end of said tubular body for retaining a lighted end of a cigarette, wherein said body has a radially outwardly extending flange formed at the outer end thereof whereby heat energy from the lighted end of the cigarette is dissipated through said receptacle and the amount of oxygen supplied to the cigarette is diminished by said receptacle.

9. The smoker's appliance according to claim 8 wherein said wall defines a hollow interior of said support body open at an upper end of said support body.

10. The smoker's appliance according to claim 9 including a lid covering said open end.

11. The smoker's appliance according to claim 9 wherein said support body includes an outwardly and upwardly extending flange formed at said bottom edge for collecting cigarette ashes falling from said receptacle.

12. A smoker's appliance for the reduction of a quantity of smoke emanating from a lighted cigarette during periods of time the lighted cigarette is not being smoked comprising:

a hollow support body having a bottom edge for engaging a supporting surface and a wall with a plurality of retaining apertures formed therein;

a plurality of receptacles for retaining cigarettes, each said receptacle having a generally tubular body with a cylindrical outer surface and a longitudinally extending aperture of polygonal cross section extending between an outer end and an inner end of said tubular body; and fastener means for maintaining each of said receptacles in an associated one of said retaining apertures whereby heat energy from the lighted end of a cigarette inserted in said longitudinally extending aperture of one of said receptacles is dissipated through said tubular body of said one receptacle and the amount of oxygen supplied to the cigarette is decreased.

13. The smoker's appliance according to claim 12 wherein said support body is frustum shaped, said wall enclosing a hollow interior with an open top and bottom.

14. The smoker's appliance according to claim 12 wherein said support body is formed of a plastic material and said receptacles are formed of a metal material.

15. The receptacle according to claim 12 wherein each said receptacle tubular body has a radially outwardly extending flange formed at said outer end and a chamfer formed on said flange at an entrance to said longitudinally extending aperture for receiving a lighted end of a cigarette.

16. The receptacle according to claim 12 wherein said fastening means includes threads formed on said cylindrical outer surface of each of said tubular bodies for threadably engaging walls of said retaining apertures.

17. A smoker's appliance for retaining a lighted cigarette in a dormant state comprising:

a support body adapted to rest on a support surface;

at least one receptacle having a tubular body with a longitudinally extending aperture of polygonal cross-section formed therein between an outer and an inner end of the tubular body for retaining a lighted end of a cigarette, said tubular body having a radially outwardly extending flange formed at the outer end thereof whereby heat energy from the lighted end of the cigarette is dissipated through said receptacle and the amount of oxygen supplied to the cigarette is diminished by said receptacle; and means for attaching said receptacle to said support body.

18. The invention defined in claim 17 wherein said support body includes a cigarette ash collecting chamber.

19. The invention defined in claim 18 wherein said chamber includes a hollow interior having an open upper end portion.

20. The invention defined in claim 19 including a lid covering the open upper end of said chamber.

21. The invention defined in claim 17 wherein said receptacle is formed of a metal material.

22. The invention defined in claim 17 wherein said receptacle includes fastening means for attaching said receptacle to said support body.

23. The invention defined in claim 17 wherein said receptacle is threadedly engaged to said means for attaching said receptacle to said support body.

* * * * *